United States Patent [19]

Stout

[11] 4,000,814

[45] Jan. 4, 1977

[54] ARTICLE CARRIER

[75] Inventor: James T. Stout, Acworth, Ga.

[73] Assignee: The Mead Corporation, Dayton, Ohio

[22] Filed: Nov. 17, 1975

[21] Appl. No.: 632,362

[52] U.S. Cl. ..... 206/187; 40/312; 206/459

[51] Int. Cl.[2] ..... B65D 75/54; B65D 85/00

[58] Field of Search ..... G09F/3/00; 206/170–193, 206/459; 40/312

[56] References Cited

UNITED STATES PATENTS

| | | | |
|---|---|---|---|
| 2,717,097 | 9/1955 | Arneson | 206/188 X |
| 3,268,113 | 8/1966 | Schuster | 206/187 |
| 3,669,306 | 6/1972 | Forrer | 206/188 |
| 3,672,539 | 6/1972 | Forrer | 206/188 X |
| 3,794,210 | 2/1974 | Stout | 206/185 X |
| 3,917,058 | 11/1975 | Wood | 206/187 X |
| 3,917,060 | 11/1975 | Wood | 206/187 |
| 3,924,740 | 12/1975 | Wood | 206/187 |

*Primary Examiner*—William Price
*Assistant Examiner*—Stephen Marcus
*Attorney, Agent, or Firm*—Walter M. Rodgers; Walter A. Rodgers

[57] ABSTRACT

A basket style article carrier having medial and transverse partitions is formed from a unitary blank and includes a bottom wall, side walls joined to the side edges of the bottom wall, end wall panels joined to the end edges of the side walls, a multiple ply handle, medial partition structure including a pair of medial panels joined to the end wall panels at one end of the carrier, riser panels foldably joined to the end wall panels at the other end of the carrier, an anchoring flap secured to one side wall, an anchoring tab secured to the medial partition structure, a transverse partition panel joined at one end thereof to the anchoring flap and at the other end thereof to the anchoring tab, and a twist interconnecting the anchoring tab and the handle.

3 Claims, 7 Drawing Figures

ARTICLE CARRIER

Article carriers are formed by machinery which operates at an extremely high rate of speed. Normally portions of the transverse partition structure in the article carrier blank are connected to the blank in such manner as to leave a portion of the transverse structure with a free end which is unconnected to the blank. During the forming operation these free ends tend to move out of the plane of the main blank. When this occurs the machinery can become jammed causing expensive down time while the obstruction is cleared.

According to this invention an article carrier is provided and comprises a bottom wall, side walls foldably joined to the side edges of the bottom wall, end wall panels foldably joined to the end edges of the side walls and extending inwardly therefrom, a multiple ply handle comprising at least one pair of handle panels, medial partition structure comprising a pair of medial panels foldably joined to the end wall panels at one end of the carrier and extending medially inward of the carrier, riser panels foldably joined to the end wall panels at the other end of the carrier and extending medially inward of the carrier, an anchoring flap secured to one side wall, an anchoring tab secured to the medial partition structure, a transverse partition panel foldably joined at one end thereof to the anchoring flap and at the other end thereof to the anchoring tab, and a twist interconnecting the anchoring tab and one of the handle panels.

For a better understanding of the invention reference may be had to the following detailed description taken in conjunction with the accompanying drawings in which FIG. 1 is a perspective view of a set-up carrier formed according to this invention;

Figure 6:
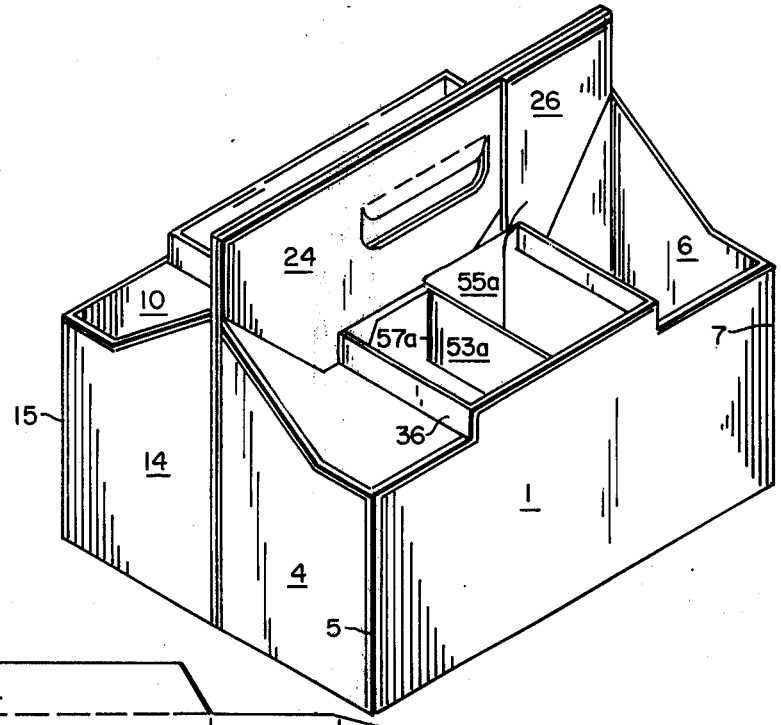
FIG. 6 is a perspective view of a set-up carrier formed according to a modification of this invention.
Figure 7:
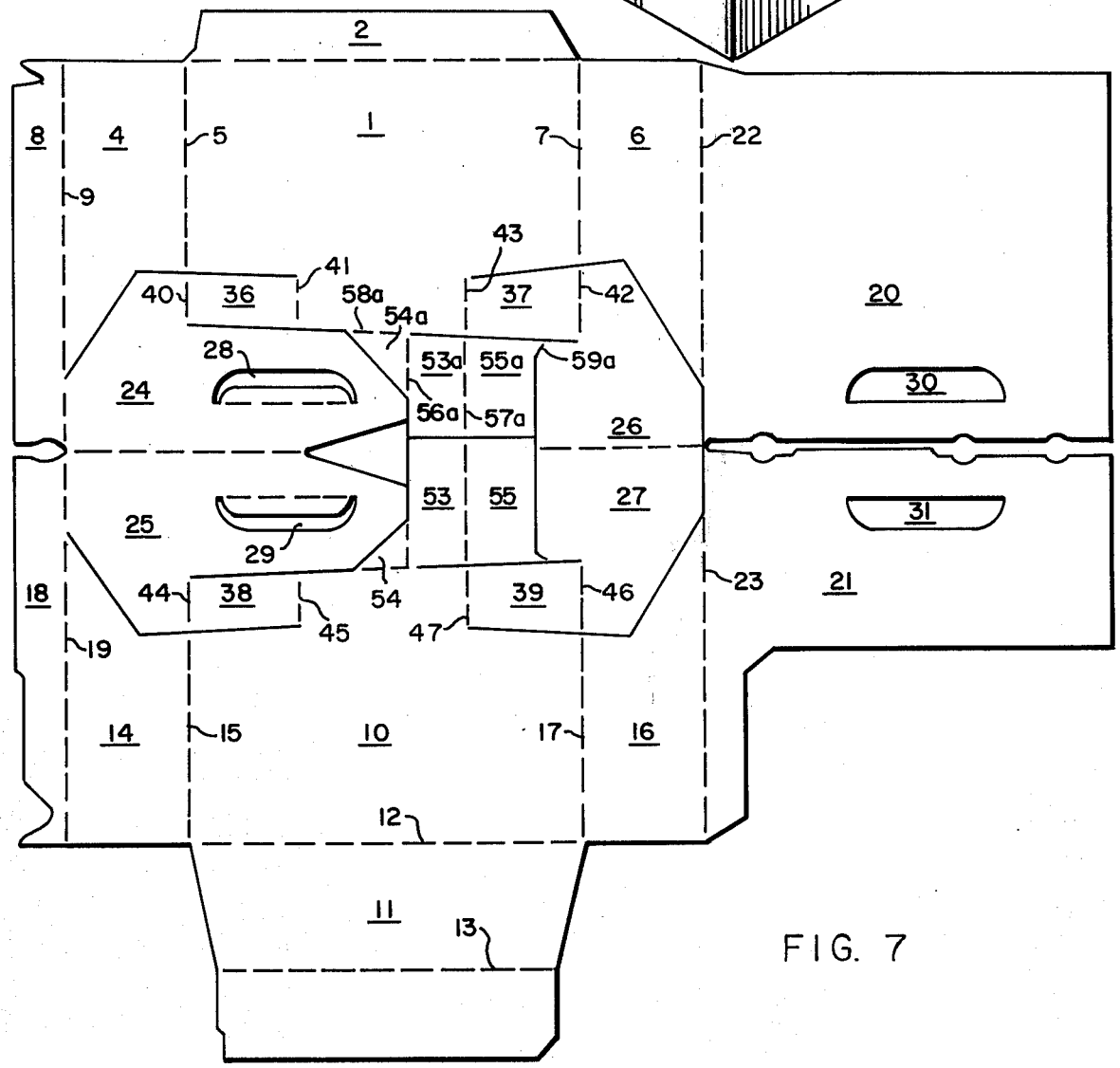

and in which FIG. 7 is a plan view of a blank from which the carrier shown in FIG. 6 is formed.

In the drawings the numeral 1 represents a side wall of a carrier to the bottom edge of which a glue flap 2 is foldably joined along fold line 3. End wall panel 4 is foldably joined to an end edge of side wall 1 along fold line 5 while end wall panel 6 is foldably joined to the opposite end edge of side wall 1 along fold line 7. A riser panel 8 is foldably joined to one edge of end wall panel 4 along fold line 9. In addition riser panel 8 is provided with locking notch 8*a*.

The structure on the opposite side of the blank is similar to that just described and includes side wall 10 to the bottom edge of which bottom panel 11 is foldably joined along fold line 12. In addition bottom panel 11 is provided with medial fold line 13. End wall panel 14 is foldably joined to side wall 10 along fold line 15 and end wall panel 16 is foldably joined to the opposite end edge of side wall 10 along fold line 17. A riser panel 18 is foldably joined to end wall panel 14 along fold line 19. Also riser panel 18 is provided with a locking notch 18*a*.

The medial partition structure of the carrier is generally designated by the letter M and includes medial panels 20 and 21 which are foldably joined to end wall panels 6 and 16 respectively along fold lines 22 and 23.

The handle structure comprises handle panels 24 and 25 which are foldably joined respectively to riser panels 8 and 18 along fold lines 9 and 19. In addition handle panels 26 and 27 are foldably joined respectively to medial panels 20 and 21 along fold lines 22 and 23. Hand gripping apertures 28 and 29 are formed in handle panels 24 and 25 respectively and similarly hand gripping apertures 30 and 31 are formed respectively in medial panels 20 and 21. Cushioning flaps 32 and 33 are foldably joined to handle panels 24 and 25 respectively along fold lines 34 and 35.

In order to provide individual article receiving cells transverse partition panels 36, 37, 38 and 39 are provided. Specifically transverse partition panel 36 is foldably joined to handle panel 24 along fold line 40 and is foldably joined to side wall 1 along fold line 41. Similarly transverse partition panel 37 is foldably joined to handle panel 26 along fold line 42 and is foldably joined to side wall 1 along fold line 43. Transverse partition panel 38 is foldably joined to handle panel 25 along fold line 44 and is foldably joined to side wall 10 along fold line 45. Also transverse partition panel 39 is foldably joined to handle panel 27 along fold line 46 and is foldably joined to side wall 10 along fold line 47. In addition transverse partition panel 48 is foldably joined to medial panel 20 along fold line 49. Anchoring tab 50 is foldably joined to transverse partition panel 48 along fold lines 51 and 52. To complete the transverse partition structure, transverse partition panel 53 is foldably joined at one end thereof to anchoring flap 54 and at the other end thereof to anchoring tab 55 along fold lines 56 and 57 respectively. In addition anchoring flap 54 is foldably joined to side wall 10 along fold line 58. Twist 59 constitutes one aspect of this invention and interconnects handle panel 27 and anchoring tab 55. Finally promotional tab 60 is foldably joined to the top edge of side wall 1 along fold line 61.

Figure 2:
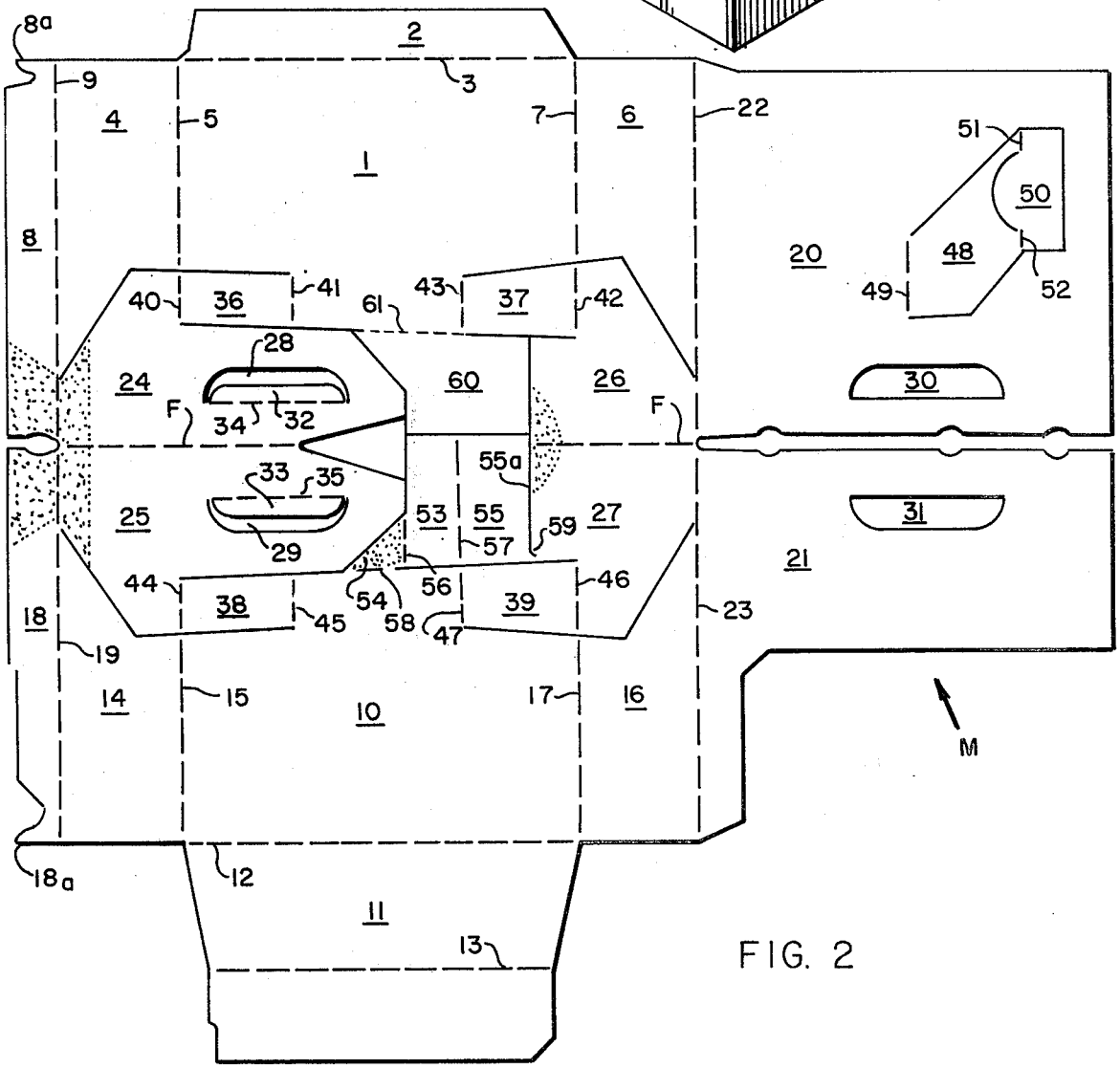
FIG. 2 is a plan view of a blank from which the carrier shown in FIG. 1 is formed.

In order to form the completed carrier from the blank shown in FIG. 2, an application of glue is first made to anchoring flap 54 as shown by stippling in FIG. 2. Thereafter anchoring flap 54 together with transverse partition panel 53 and anchoring tab 55 are elevated and folded along fold line 58 into a position of flat face contacting relation with the inner surface of side wall 10. During this operation twist 59 acts to keep free end portion 55*a* of anchoring tab 55 in the proper position during the high speed movement of the carrier blank during the forming operation. It can be seen that twist 59 actually rotates due to the stationary position of handle panel 27 during the rotation of anchoring tab 55. Although twist 59 rotates and is actually deformed during this operation, it does not break but acts to maintain the proper position of anchoring flap 55, transverse partition panel 53, and anchoring flap 54.

Thereafter an application of glue is made to riser panels 8 and 18 and to all the handle panels 24, 25, 26 and 27 as indicated by stippling in FIG. 2. Following this application of glue, the end wall panels 4 and 14 are elevated and folded toward the right along fold lines 5 and 15. Simultaneously handle panels 24 and 25 are folded along fold lines 9 and 19 and transverse partition panels 36 and 38 are folded along fold lines 40 and 41 and 44 and 45 respectively. When this folding operation is completed, the blank then appears as shown in FIG. 3 with handle panels 24 and 25 adhered to the inner surfaces of handle panels 26 and 27 and with riser panels 8 and 18 secured to the inner surfaces of handle panels 24 and 25 respectively.

Figure 3:
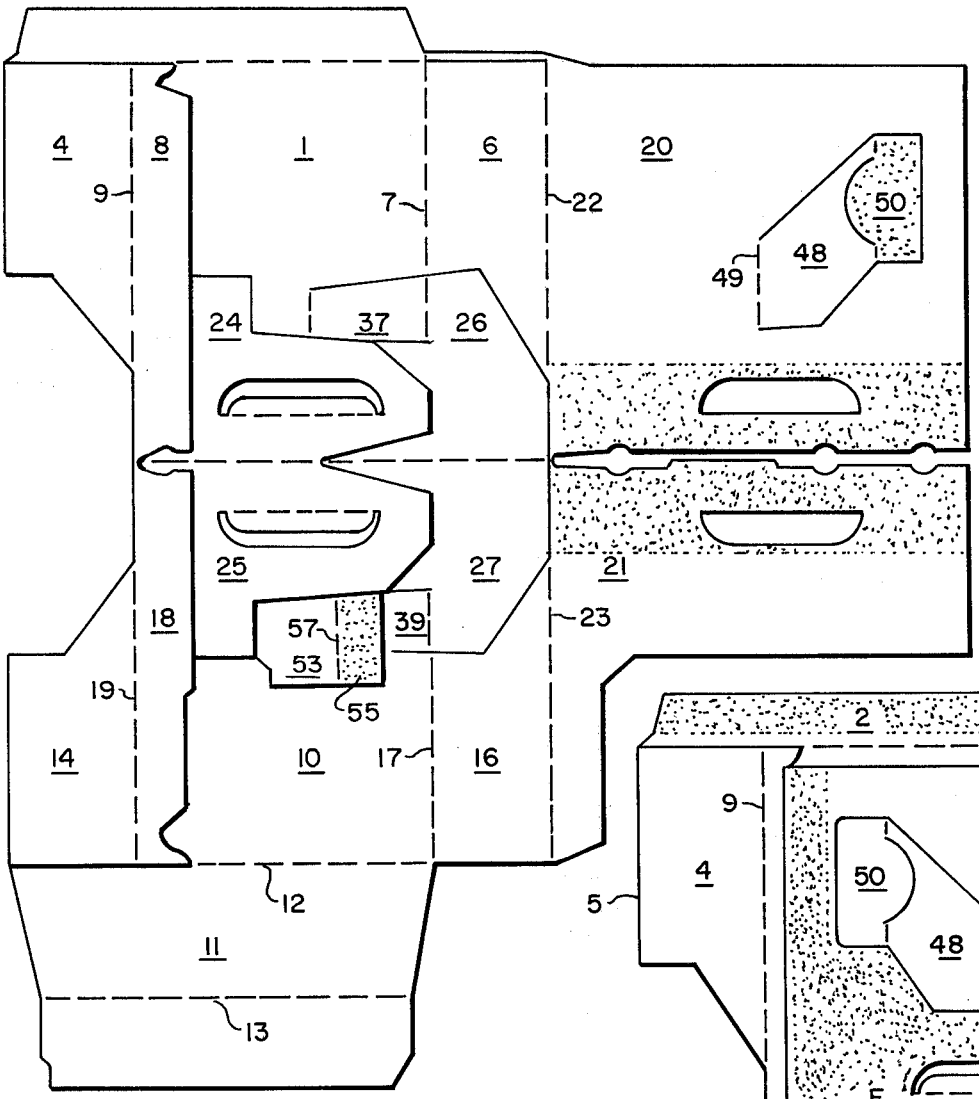
FIGS. 3 and 4 depict intermediate stages through which the blank of FIG. 2 is manipulated in order to form a complete and collapsed carrier as depicted in FIG. 5.

With the parts of the carrier in the positions shown in FIG. 3, an application of glue is made to medial panels 20 and 21 and anchoring flaps 50 and 55. Then medial panels 20 and 21 are elevated and folded toward the left along fold lines 22 and 23 respectively. By this operation medial panel 21 becomes adhered to handle panels 25 and 27 as well as to anchoring tab 55. Likewise medial panel 20 becomes adhered to handle panels 24 and 26 and in addition anchoring tab 50 becomes adhered to side wall 1. Thereafter bottom panel 11 is folded along medial fold line 13. The carrier then appears as shown in FIG. 4.

Figure 4:
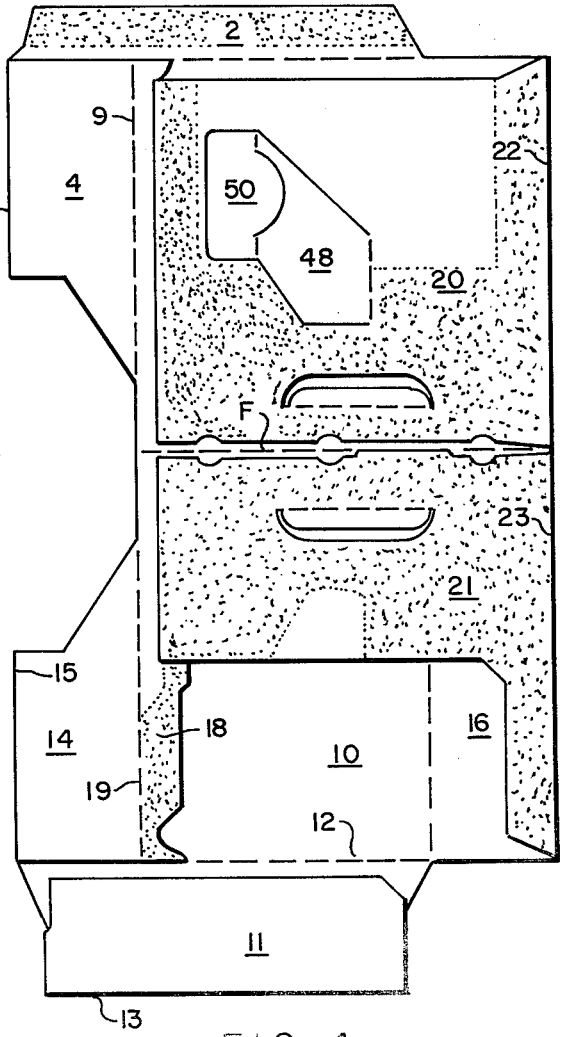

Then an application of glue is made to the carrier as indicated by stippling in FIG. 4. More specifically glue is applied to glue flap 2, medial panels 20 and 21, and riser panel 18. Thereafter the portions of the blank which are disposed above fold line F as viewed in FIG. 4 are elevated and folded into the position shown in FIG. 5 which represents the completed carrier in collapsed condition.

Figure 1:
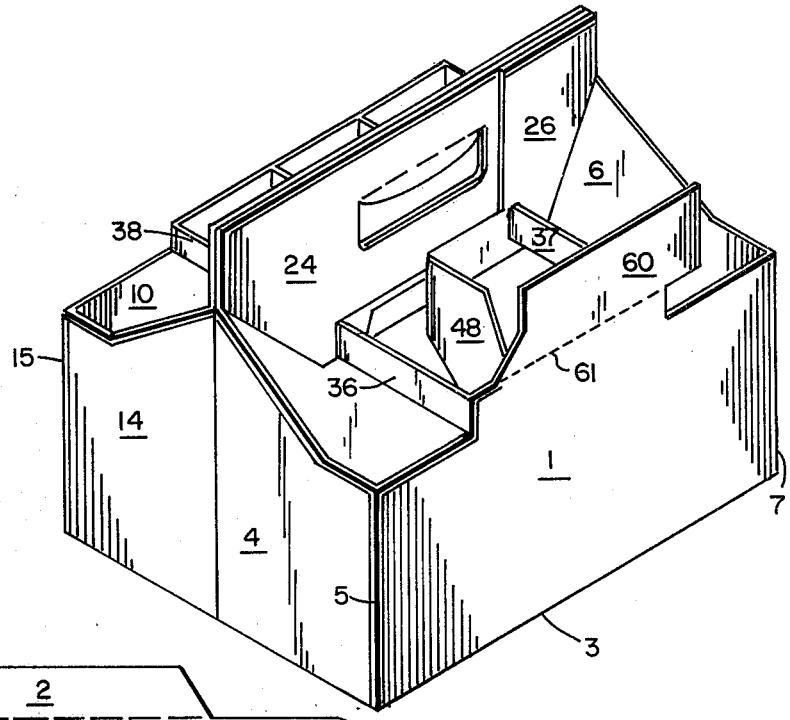
Figure 5:
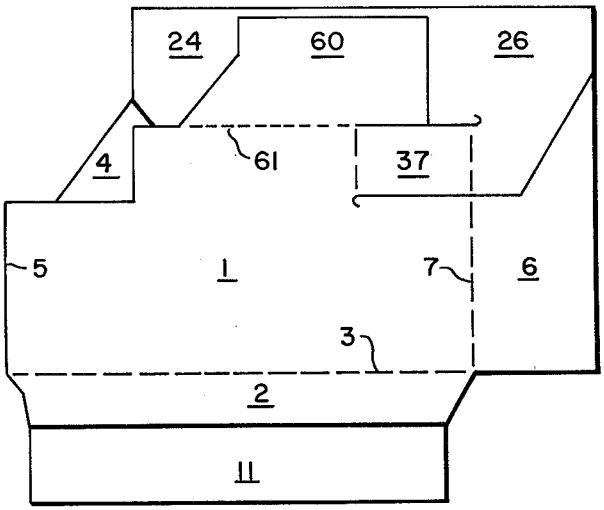

In order to set up the carrier from its collapsed condition shown in FIG. 5 into the condition shown in FIG. 1, it is simply necessary to secure the side walls 1 and 10 against movement toward the left and to apply a force toward the left to the medial edges of end wall panels 6 and 16. This expands the carrier and moves the side walls apart. Simultaneously the bottom wall 11 folds into a flat plane. The carrier is maintained in set-up condition by cooperation between the locking notches 8*a* and 18*a* and one end of bottom wall 11. The carrier then appears as shown in FIG. 1.

FIG. 6 represents a modification of the invention with the essential difference being the elimination of promotional tab 60 and its replacement with a transverse partition. In addition the transverse partition panel 48 and its associated anchoring tab 50 as shown in the blank of FIG. 2 are eliminated in the blank of FIG. 7. More specifically as shown in FIG. 7 transverse partition panel 53*a* is provided and includes an anchoring tab 55*a* which is foldably joined thereto along fold line 57*a*. Also anchoring flap 54*a* is foldably joined to side wall 1 along fold line 58*a* and in addition is foldably joined to transverse partition panel 53*a* along fold line 56*a*. Finally twist 59*a* is provided and acts to interconnect anchoring tab 55*a* with its adjacent handle panel 26. The folding and gluing operation of this transverse partition structure is essentially the same as that associated with the similarly configured transverse partition structure comprising transverse partition panel 53, anchoring tab 55, and anchoring flap 54 and therefore will not be discussed in detail. The remaining folding and gluing operations are the same as discussed in connection with the carton shown in perspective in FIG. 1.

Therefore by this invention an article carrier is provided which eliminates the problem of machinery shut down caused by the mispositioning of certain transverse partition elements. This result is accomplished by the means of a twist which also has the beneficial characteristic of being unobtrusive and not unsightly in the finished carrier.

The embodiments of the invention in which an exclusive property or privilege is claimed are defined as follows:

1. An article carrier comprising a bottom wall, side walls foldably joined to the side edges of said bottom wall, end wall panels foldably joined to the end edges of said side walls and extending inwardly therefrom, a multiple ply handle comprising at least one pair of handle panels, medial partition structure including a pair of medial panels foldably joined respectively to said end wall panels at one end of the carrier along the edges thereof remote from said side walls and extending medially inward of the carrier, riser panels foldably joined respectively to said end wall panels at the other end of the carrier along the edges thereof remote from said side walls and extending medially inward of the carrier, an anchoring flap secured to one of said side walls, an anchoring tab secured to said medial partition structure on one side of said handle, a transverse partition panel foldably joined at one end thereof to said anchoring flap and at the other end thereof to said anchoring tab, a twist interconnecting said anchoring tab and one of said handle panels, a promotional tab foldably joined to the top edge of the other of said side walls, and said side walls respectively comprising high center portions, said promotional tab being foldably joined to the high center portion of said other side wall.

2. An article carrier according to claim 1 wherein an anchoring tab is secured to the other of said side walls and wherein a transverse partition panel is foldably joined at one end thereof to said anchoring tab secured to said other side wall and at the other end thereof to said medial partition structure.

3. An article carrier blank comprising a bottom wall, a first side wall foldably joined to a side edge of said bottom wall, a first pair of end wall panels foldably joined respectively to the end edges of said first side wall, a first riser panel foldably joined to one of said first pair of end wall panels remote from said first side wall, a first handle panel foldably joined to said first riser panel, a first medial panel foldably joined to the other of said first pair of end wall panels remote from the other of said first pair of end wall panels remote from said first side wall, a second handle panel foldably joined to said first medial panel, a third handle panel foldably joined to said first handle panel along the top edge thereof, a second riser panel foldably joined to said third handle panel, one of a second pair of end wall panels foldably joined to said second riser panel, a second side wall foldably joined to said one of a second pair of end wall panels remote from said second riser panel, the other of a second pair of end wall panels foldably joined to said second side wall remote from said one of a second pair of end wall panels, a second medial panel foldably joined to said other of a second pair of end wall panels remote from said second side wall, a fourth handle panel foldably joined to said second handle panel along the top edge thereof and to said second medial panel, the upper portions of said side walls respectively comprising high center portions, an anchoring flap foldably joined to said high center portion of one of said side walls, a transverse partition panel foldably joined to said anchoring flap, an anchoring tab foldably joined to said transverse partition panel remote from said anchoring flap, a twist interconnecting said anchoring tab and the adjacent one of said handle panels, and a promotional tab foldably joined to the high center portion of the other of said side walls.

* * * * *